US006830442B2

(12) United States Patent
Cecil

(10) Patent No.: US 6,830,442 B2
(45) Date of Patent: Dec. 14, 2004

(54) ROTARY TABLET PRESS

(76) Inventor: William Alvin Cecil, 108 Creel La., Bardstown, KY (US) 40004

( * ) Notice: Subject to any disclaimer, the term of this patent is extended or adjusted under 35 U.S.C. 154(b) by 0 days.

(21) Appl. No.: 10/215,585

(22) Filed: Aug. 9, 2002

(65) Prior Publication Data

US 2003/0031744 A1 Feb. 13, 2003

Related U.S. Application Data

(60) Provisional application No. 60/311,033, filed on Aug. 9, 2001.

(51) Int. Cl.[7] ..... B29C 43/08

(52) U.S. Cl. ..... 425/107; 425/217; 425/261; 425/345

(58) Field of Search ..... 425/107, 344, 425/345, 351, 356, 215, 217, 261; 100/196–198, 265; 164/149

(56) References Cited

U.S. PATENT DOCUMENTS 3,891,375 A * 6/1975 Pilewski et al. ..... 425/344
4,259,049 A * 3/1981 Willich ..... 425/73
4,292,017 A * 9/1981 Doepel ..... 425/345
4,408,975 A * 10/1983 Hack ..... 425/231
4,664,173 A * 5/1987 Wolniak ..... 164/312
4,943,227 A * 7/1990 Facchini ..... 425/345
5,116,214 A * 5/1992 Korsch et al. ..... 425/345

* cited by examiner

*Primary Examiner*—Robert Davis
*Assistant Examiner*—Thu Khanh T. Nguyen
(74) *Attorney, Agent, or Firm*—Charles L. Thomason

(57) ABSTRACT

A rotary table press having a rotatable die table, an upper punch turret and a lower punch turret is provided with a die table that is compartmentalized from the lubricated guides and punch bars to keep dust away from the parts in the die table compartment. Lubrication to the punch bars and guides in the turret is sealed off from the die table compartment. Further improvements pertain to the prior art difficulty with removal and replacement of dies, and removal of the die table. A hydraulic die removal assembly enables the operator to remove the dies, in situ, from the die table. Also, the improved apparatus enables the maintenance worker to pull out the part of the driving shaft that passes through the center of the turrets and die table, then pins are retracted, and with some related adjustments, that enables the die table to be removed from between the turrets. The procedure basically is reversed to re-install the die table.

13 Claims, 9 Drawing Sheets

ROTARY TABLET PRESS

PRIORITY CLAIM

This application claims priority to U.S. Provisional Application No. 60/311,033 filed Aug. 9, 2001.

BACKGROUND OF THE INVENTION

The apparatus comprising a typical rotary tablet press includes a rotatable die table, an upper punch turret and a lower punch turret. The common design can be described generally as the turret and die table being circular in shape, and along the area near their circumferential edge, the turret and table have a number of openings machined through these parts, as depicted in FIG. 2*a*.

Fitted in the upper and lower punch turrets are cylindrical punch bars that move reciprocally within machined guide cylinders. The punch bars have a head at one end, which is suitably machined for contacting a cam or wheel, and at the other end the punch bar has a tip that goes into a die fitted into the die table. The tip is shaped for forming a tablet from powder that is fed into the die.

Typically, the turrets and the die table are joined together, so that the assembly can rotate around a central axis. As it rotates, the head of a punch bar comes into contact with a cam, which pushes the punch into the die, and there the tablet is formed by compression. As the rotation continues, the punches move off the cams, and the tablet is ejected from the die.

In the prior art presses, the punch bars and dies were removable, but that required a laborious process of taking out the punch bars from the turrets, and forcing the dies out of the die table, and in some instances, removing of the entire rotatable assembly. New dies would be hammered into the die table, and then, the other parts, such as the punches were re-installed.

Such work can be required routinely in order to change the shape of the tablet to be made, or required for major maintenance or repair of the punches, dies and other moving parts of the turrets and die table. Such maintenance to the prior art presses would be needed because the powder from which the tablets are made often has an abrasive or corrosive effect on the moving and machined parts. These dust problems, and the need to avoid that is recognized in U.S. Pat. No. 5,462,427 to Kramer and U.S. Pat. No. 4,259,049 to Willich.

DETAILED DESCRIPTION

The present invention is an improved apparatus that simplifies routine maintenance, and reduces the need to and the labor required to tear down the rotary tablet press. To address the dust problems encountered in the prior art, the improved apparatus has a die table that is compartmentalized from the lubricated guides and punch bars in the turrets. That compartmentalization keeps the dust from the powder being pressed into tablets away from the parts of the turrets that may be harmed by the dust, which now will remain in the die table compartment. Also, the lubrication that is provided to the punch bars and guides in the turret is scaled off from the die table compartment where there is airborne powder. These improvements serve to reduce the cause of and the frequency of the maintenance problems that prior art rotary tablet presses experience due to dust attacking the machined guides and punch bars in the turrets.

Figure 1:
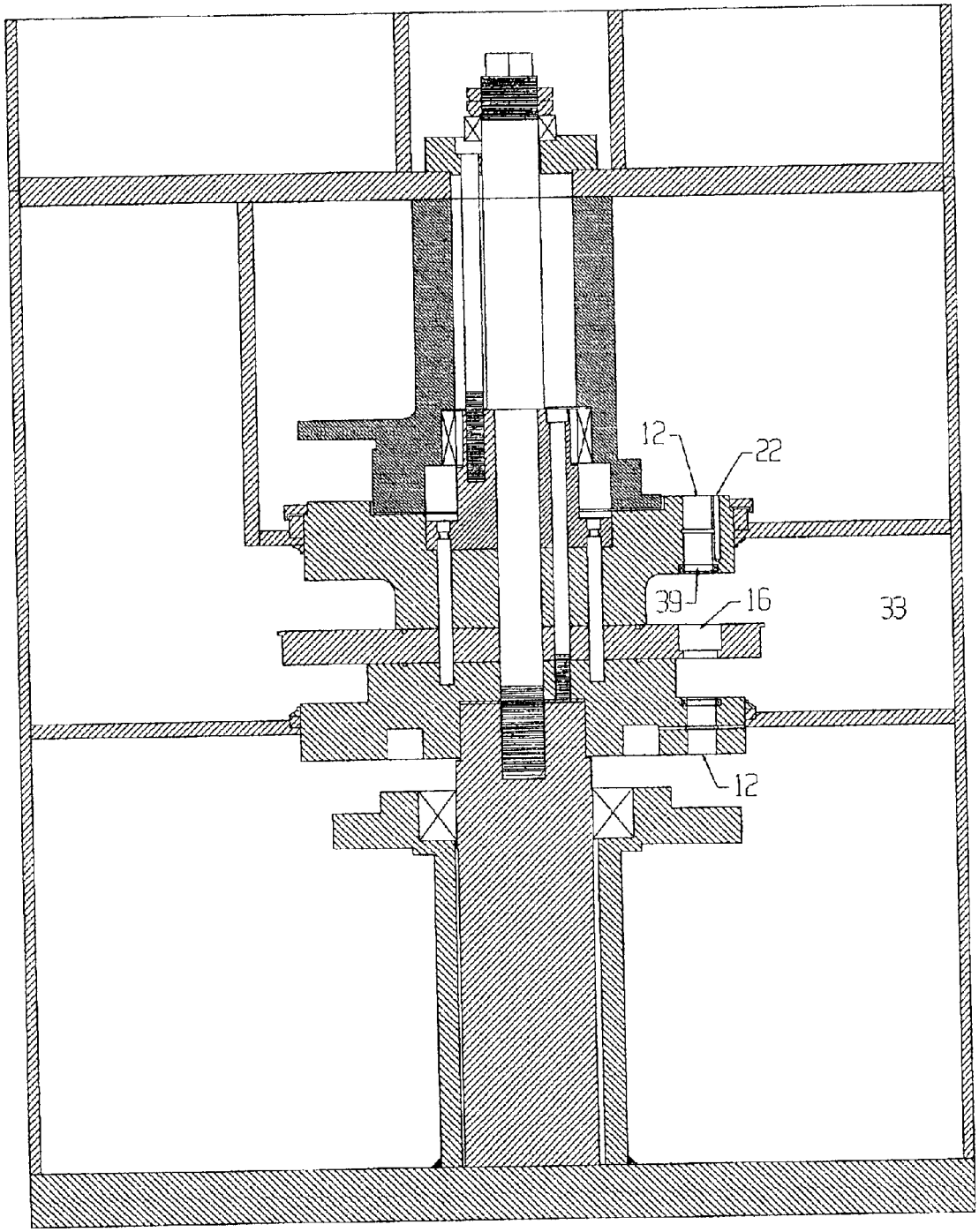
FIG. 1 is a cross-section view of the punch turrets.
Figure 2:
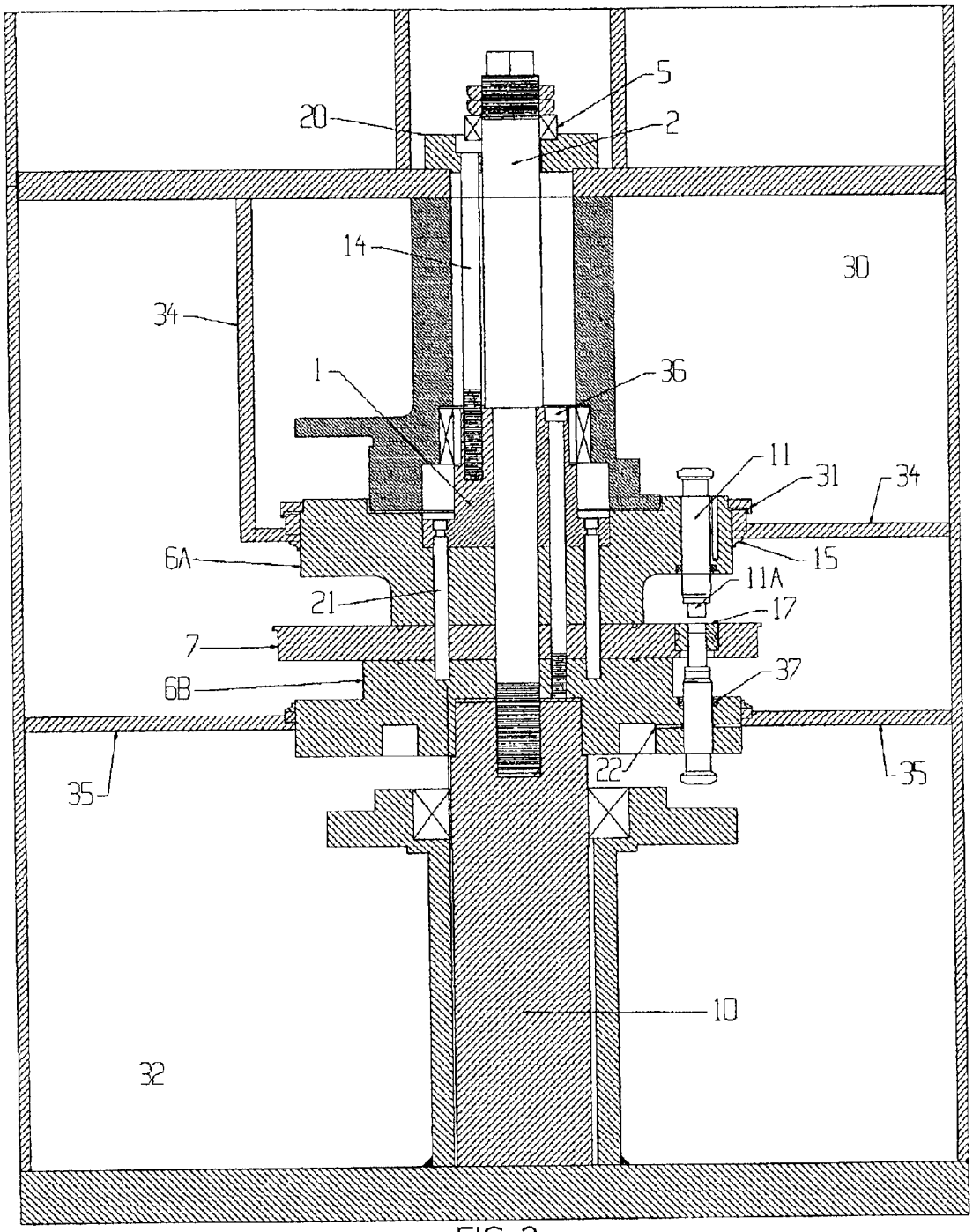
FIG. 2 is a cross section view of the turrets and punch bars.

An illustrative embodiment is shown in FIG. 1 and FIG. 2, which are a cross-section of the turrets, depicted there to show a punch bar 11, the die table 7, and connecting means that provide rotation to that assembly.

Figure 5:
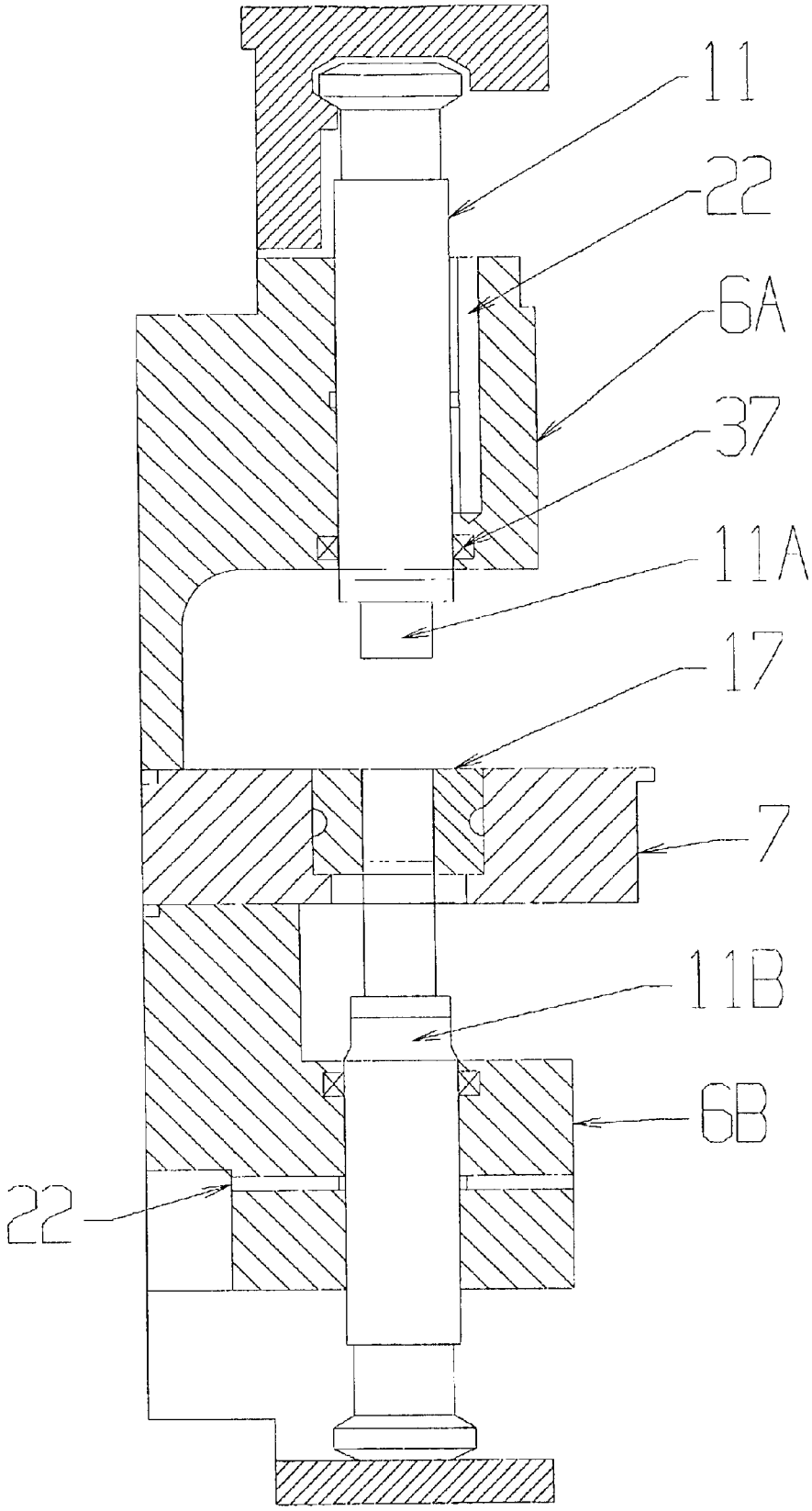
FIGS. 5, 6 and 7 show the punch bars, including replaceable tips.

Referring to FIGS. 1 and 2, those cross-section views show the upper punch turret 6A and the lower punch turret 6B and the die table 7 around the central axis of the draw bolt 2 that is threaded into the main drive shaft 10. The turrets and die table are joined by connecting means, including by dowel pins 21 attached to adaptor 1, and to the die table draw bolts 36. FIG. 5 depicts the punch bars 11 in the turret bores 12 of the 6A and the lower punch turret 6B. These punch bars compress the tablet material in the die 17 in the die table 7.

Figure 4:
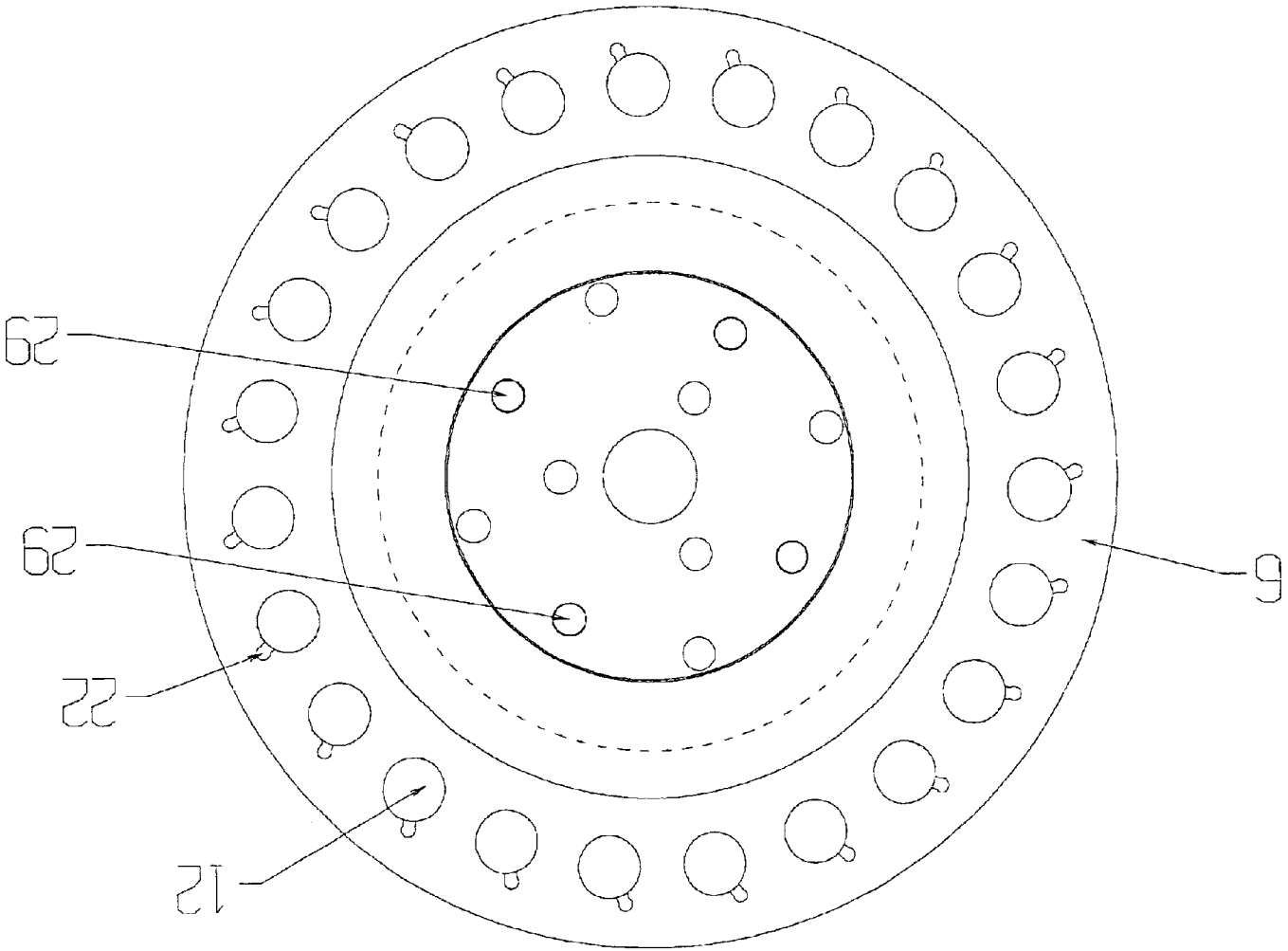
FIG. 4 is a top view of an upper punch turret.

It is understood that there are a plurality of these punches and dies in the rotary tablet press. As shown in FIG. 2, the rotary tablet press of the present invention has an upper 30 and a lower 32 compartment in which continuous lubrication is applied primarily to the moving and machined parts in the turrets. These upper and lower compartments 30 and 32 are separated by structural barriers 34 and 35 from the compartment in which the tablets are compressed. In the compression compartment 33, the tips 11*a* of the punches, the die table and dies are exposed to the powder being compressed into tablets. The compression compartment 33 is separated from the lubrication areas in the upper and lower compartments by seals 15 and 31. There are walls 34 and 35 that extend to near the edge of the turret, in both the upper 30 and lower 32 compartments. Between the wall and the turrets is at least one seal, and the sealed wall at the edge of the turrets is a barrier between the dust-filled compression compartment 33 and the lubrication areas in the upper and lower compartments. Also providing separation between the oiled and the dusty compartments are seals 37 inside the guides 12 in which the punches move reciprocally. A groove 39 is machined in the bores 12 in the turrets, and into that an oil seal 37 is placed. In the preferred embodiment, the turrets have oil passages and keyways 22 cut into them to provide means for lubrication to be applied continuously to the punches. FIG. 4 depicts the upper turret, which has bores for the punches, which have keyways into which oil fills from the continuous lubrication system. The preferred embodiment has a drilled hole behind the keyway that is to let the oil flow in and out when the punch bar is stroking up and down. This serves to eliminate pumping action and pressure, and so keep the oil seals from blowing out or breaking. The upper and lower punch compression compartments of the present invention are totally sealed, preventing any powder or other contaminants from entering. This also allows all moving parts to be lubricated by a continuous lubricating system. The oil punch seals allow the punches 11 to receive a fresh dose of oil after each stroke, eliminating sticking of the punches in their turret bores.

The embodiment shown in FIG. 1 and FIG. 2, indicates the sealing rings at 31 and 15 adjacent to the turrets 6A and 6B at the walls 34 and 35 between the compartments. The oil seal within the guides in the turrets is indicated there as 37. Such seals are an improvement over the boots and cuffs used in U.S. Pat. No. 5,462,427 to Kramer and U.S. Pat. No. 3,999,922 to Shimada. Referring to FIG. 2, the present invention has continuous lubricated upper and lower compartments. In the upper sealed compartment 30 oil circulated in this compartment, lubricates all moving parts including the punch turret bores down to where the seal 37 is located. Below that is the compression compartment 33 that is sealed-off and kept dry and free from oil contamination. Below that is the lower sealed compartment 32. Oil circulated in this lower compartment lubricates all moving parts including the lower punch turret bores up to where the seal 37 is located.

Further improvements pertain to the prior art difficulty with removal and replacement of the dies, and with the removal of the die table 7. When tablets of a different shape or compound are to be made, a routine need arises to make changes to the rotary tablet press. A similar operation is involved when wear and tear causes the dies and punches to need replacing. The prior art method can involve the removal of the die table from the machine, and typically involves taking the dies 17 out of the table, then replacing the dies. In this same procedure, the punch bars 11 had to be removed, either to replace them with punches having a tip suited to make the shape and size of tablet in the new dies 17, or the punches and even the turrets had to be removed when one die table was taken out of the machinery to be replaced with another die table fitted with replacement dies.

Figure 6:
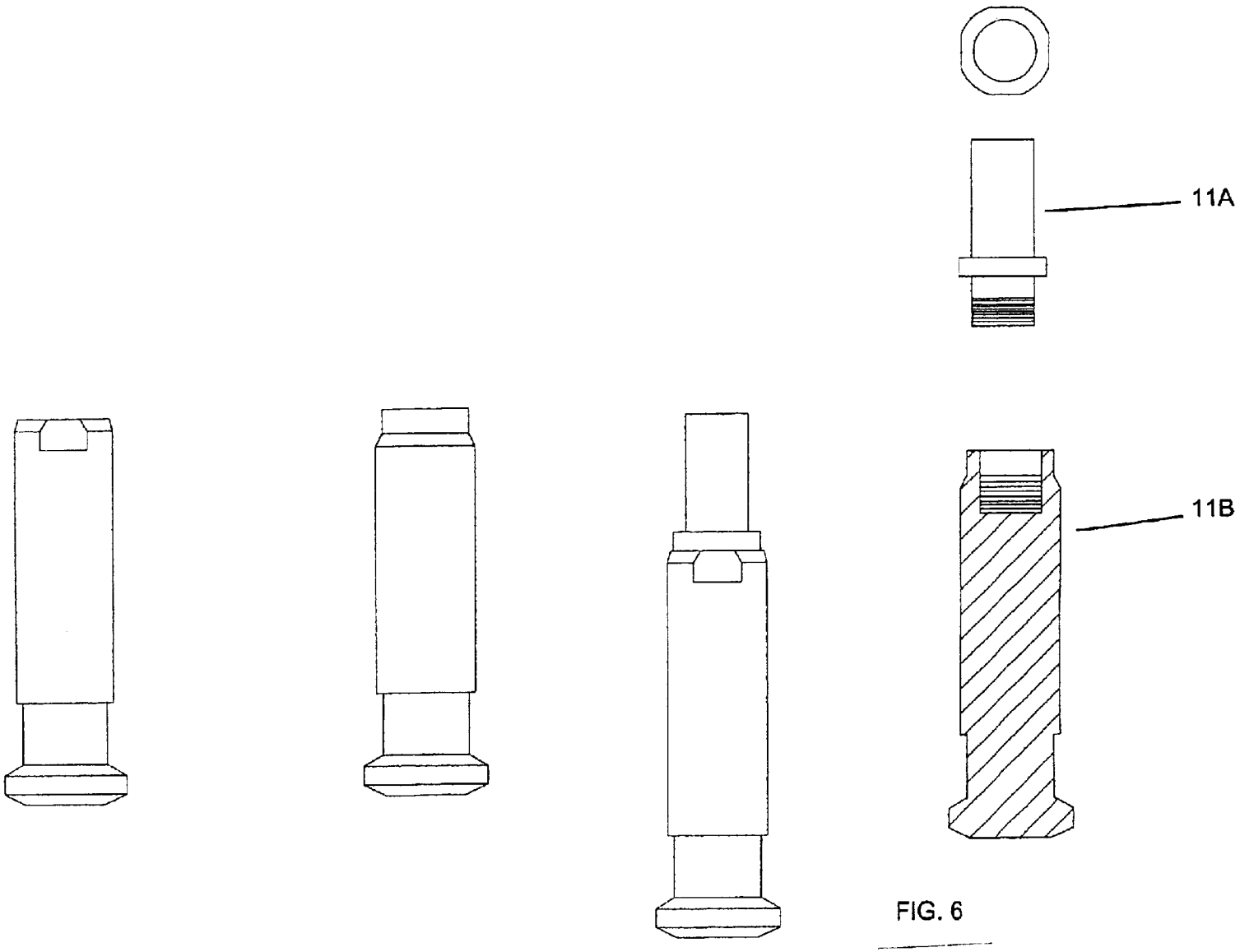
Figure 7:
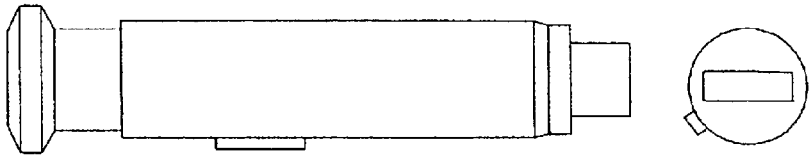
Figure 7:
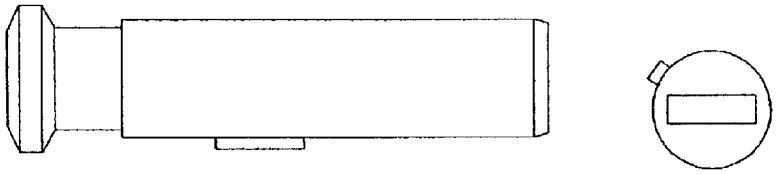
Figure 7:
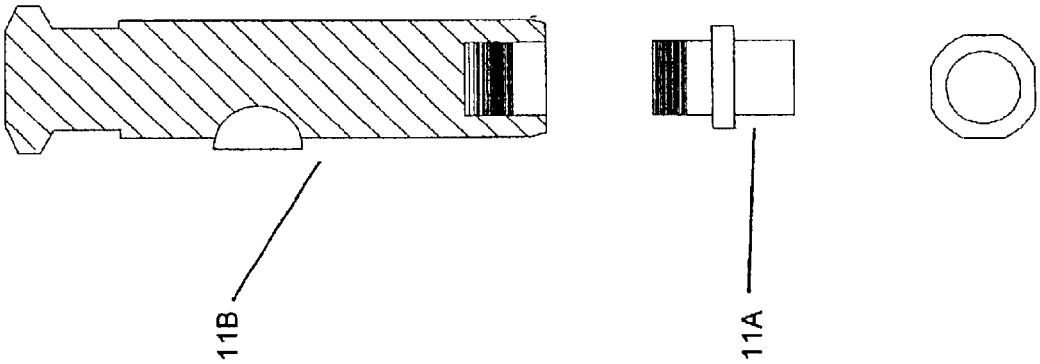

Typically, the punches are formed or machined as a single bar, having the shapes shown in the U.S. Pat. No. 6,050,798 to Konig and the U.S. Pat. No. 4,259,049 to Willich, which has a punch bar, there called a plunger, having a head that rides over a cam, and at the other end, a tip that is moved into the die. In the present invention, the punch bar 11 has a removable tip 11*a*, as in FIGS. 5, 6 and 7, which offers several advantages. First, worn tips can be replaced easily. The preferred version of this improvement has the tip threaded into the punch bar. Returning to FIG. 6, the lower punch has punch bar 11*b* that is internally threaded, and a tip or insert 11*a* with threads to fit with 11*b*. Second, a replaceable tip can have a shape different from the tip being replaced, so that a differently-shaped tablet can be made. For example, it is advantageous to be able to switch the press over from one version of tablet to another without having an extended downtime period, during which no tablet can be pressed. The improvement allows a tablet of one thickness to be made with a tip, then that tip easily can be replaced with a differently-shaped tip, so that a tablet of a different thickness or shape could be molded in the die. Third, being able to remove the tips provides clearance inside the assembly area to perform other maintenance and inspection. The preferred embodiment of the punches with replaceable tips is illustrated in FIGS. 5, 6 and 7. FIG. 6 shows an embodiment of the lower punch with the inserts installed. In the embodiment, the punch bar is approximately 5.25 inches in length, and its barrel has a diameter of approximately 0.875 inches up to 0.998 inches. The punch bar receives the insert into an internally threaded opening that preferably is approximately 0.6250 inches in diameter. FIG. 7 shows an embodiment of the upper punch, including the punch bar with the insert installed. Also, a view on FIG. 7 shows the tip of an insert for round tablets, and also an insert for non-round tablets. These views also show that the punch bar has a key that stick out, and which is needed for non-round tablets. Next, the removable tips are utilized with a further improvement embodied in the present invention, which provides in situ, die removal using a hydraulic assembly.

Figure 3:
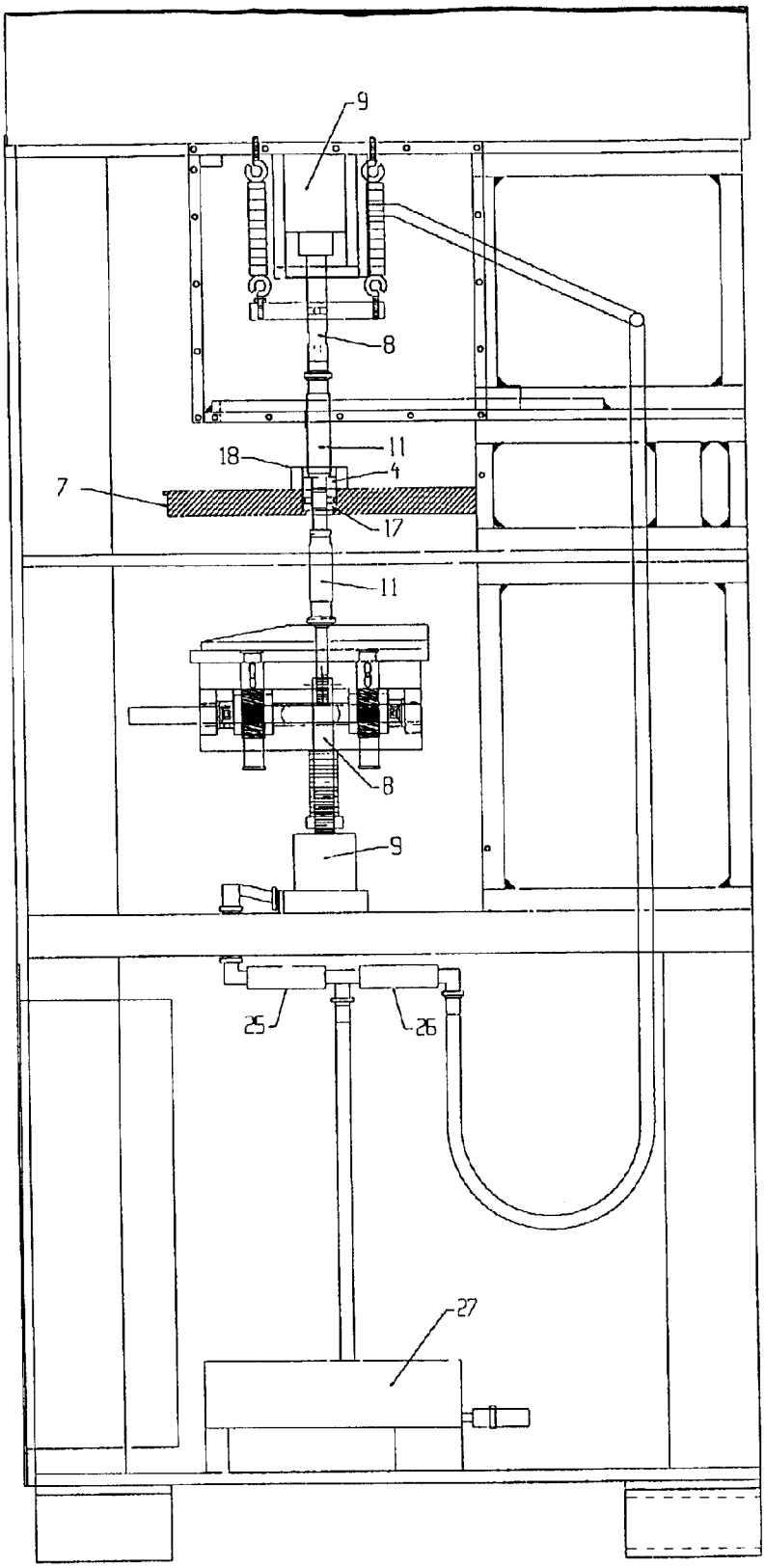
FIGS. 3, 3A and 3B depict a partial view of the interior of the cabinet, and of the hydraulic die replacement apparatus.

The hydraulic die removal assembly enables the operator to remove the dies, in situ, from the die table, that is, to remove the dies from the machine without hammering the dies out, as was the prior art practice. In the typical arrangement, the die table has round openings 16 machined into it, as in FIG. 1. The dies 17 have that same roundness, so that they fit tightly in the opening bored in die table. In the present invention, the rotary tablet press has a hydraulic cylinder 9 with a push rod 8 that is used to remove the dies in situ. As depicted in FIG. 3, the cabinet for the installation has an upper cylinder for die installation and a lower cylinder for die removal, both which have a hydraulic cylinder valve. The push rod, which the hydraulic cylinder moves, is positioned below the punches in the lower turret, and aligned with the path on which the punches are rotated. With a punch positioned above the push rod, the hydraulic cylinder is actuated, and the rod 8 pushes the punch up against the die 17, and so forces the die out of the die table. The new die can be replaced using the same mechanism and method, and in the preferred embodiment, that is by the use of second hydraulic cylinder and second push rod located above the upper turret 6A and die table 7. That embodiment is shown in FIG. 3, and FIGS. 3*a* and 3*b*, which in separate views show the die in place and after being removed, according to the following procedure.

For the die to be installed in the die table, the turret is rotated to where the mark on the punch hole in the turret lines up with a pointer, mounted stationary by the turret mark. The mark and pointer aligns the upper and lower punches directly above the hydraulic cylinder and the spring-returned push rods. The valve on the hydraulic marked "lower" 25 needs to be in the off position and the valve marked "upper" 26 needs to be in the "on" position. This lets oil go only to the upper cylinder when the pump is activated. When persons skilled in the art install a die, a die aligning sleeve 18 usually is used. Slide spacer 4 over punch tip. Slide the die alignment sleeve under punch tip and align. Those skilled in the art will prefer to install die table support, which keeps die table from bending while pushing die in and out. Activate pump until die is totally in opening on die table.

Figure 3A:
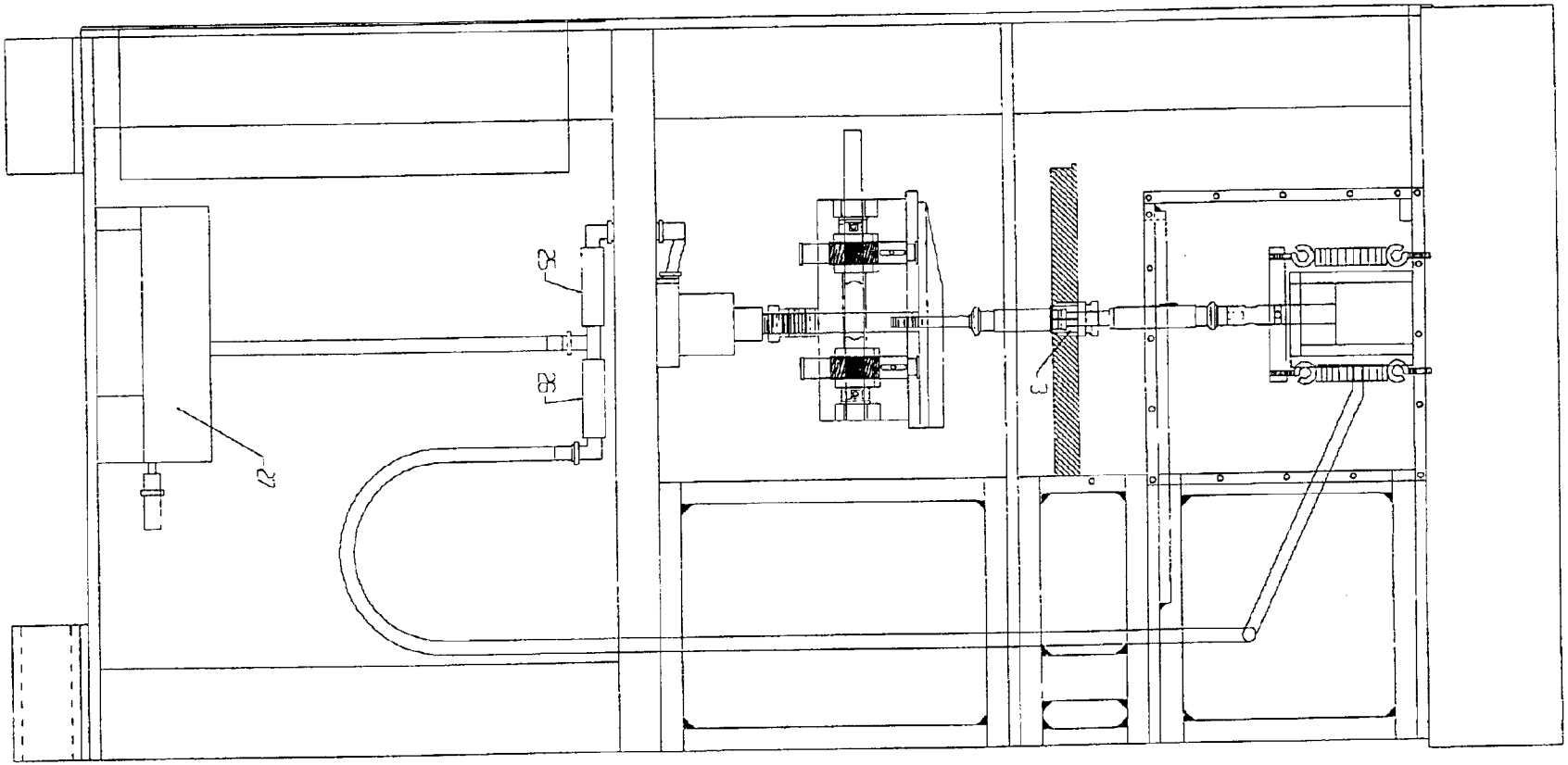
Figure 3B:
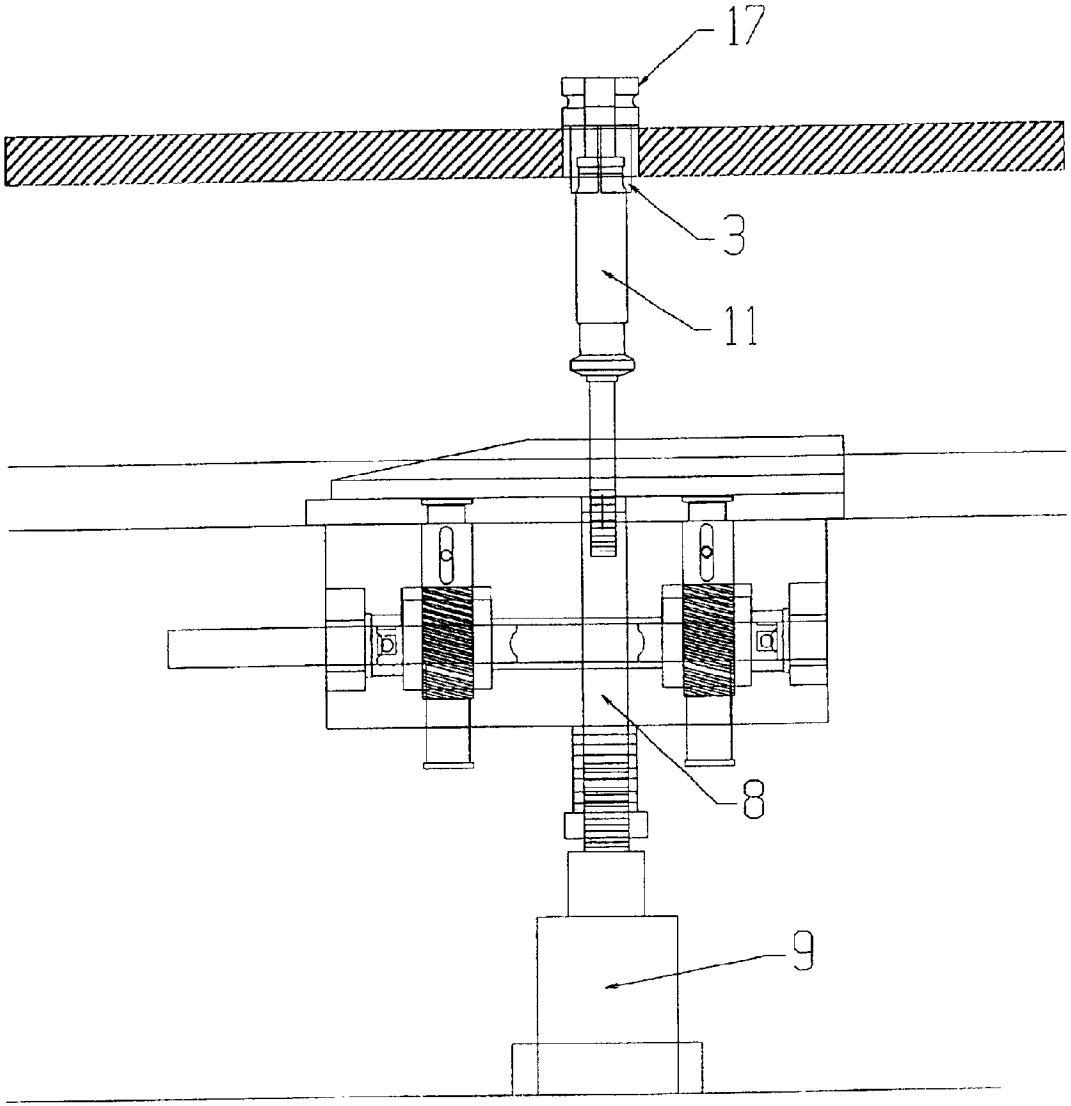

The operation of the hydraulic die removal assembly, as shown in FIG. 3*a* after the die was removed from the die table, is as follows. The turret is rotated to where the mark on the punch hole in turret lines up with a pointer mounted stationary by the turret mark. This aligns your upper and lower punches directly above hydraulic spring returned push rods. There are marks at every punch station on the turret so that the apparatus will only remove one die at a time. The valve on the hydraulic marked "lower" needs to be in the "on" position and the valve marked "upper" 26 needs to be in the "off" position. This lets oil go only to the lower cylinder when the pump is activated. Place split spacer 3 around the lower punch tip and clamp in place. In the preferred embodiment, the technician installs a die table support due to keep the die table from bending when pushing die in and out. Activate hydraulic pump until die is totally out of the die table. There can be variations to the die removal and installation procedures, including based on the shape of the punch.

In the typical prior art press, the punch has a barrel that is larger in diameter than the tip, which moves inside the die. The hydraulic cylinder and push rod move the punch farther than when the punch moves over the cam during the tablet making process. Thus, the larger barrel of the punch bar does not fit inside the open area in the die, and the thick barrel can be pushed against the die and that will force the die out of the die table. In general, that method works with the present invention, however, the replaceable tips for the punches provide another feature. When the dies are to be removed, the punch tips are taken off, and replaced with a tip suitable for pushing out the die. Similarly, that replaceable tip can be shaped suitably for pushing a new die into the die table, again using the force provided by the hydraulic cylinder and push rod. The upper and lower punches with replaceable tips, which can be removed without having to remove upper and lower punch barrels from the upper and lower turret, are depicted in FIG. 5. A preferred embodiment of the punches and tips are depicted in FIG. 6 and FIG. 7.

In the manufacture of non-round shaped tips, the shape should bear a relationship to the keyway, and should keep the threaded inner diameter in the same relationship as the keyway. To machine a shaped tip for, in relationship to the keyway on punch barrel, screw punch tip into the punch barrel with punch barrel in keyed fixture set and located as needed. Torque the tip to specified inch pounds and machine desired shape. Remove the punch tip and screw in the next punch tip and torque to exact inch pounds and machine desired punch shape. Repeat until the full set is complete.

Next, the present apparatus provides the improvement of the die table being more easily removable and replaceable. In the prior art, the turrets and die table were rotated on a one-piece shaft. For example, in the Willich patent, its "compressing stations . . . are all circumferentially spaced around a central upright shaft", and in U.S. Pat. No. 3,999,922 to Shimada, the assembly is "rotatably mounted on a shaft." The use of one central shaft, and the related rotational machinery, meant that removal and replacement of the die table required nearly tearing-down the entire turret and table apparatus.

The present invention addresses that maintenance problem with a two-piece shaft 2 and 10, and retractable dowel pins 21 between the turrets and the die table. This assembly is shown in cross-section as depicted on FIG. 1 and FIG. 2. In the improved apparatus, the maintenance worker can pull out the draw bolt 2 of the central drive shaft that passes through the center of the turrets 6A and 6B and die table 7, then the pins 21 are retracted, and with some related adjustments, that enables the die table to be removed from between the turrets. Referring to FIG. 1, the present invention is structured to permit die table removal according to the following procedure. The draw bolt 2 that is joined to the main drive shaft is removed, and also removed are thrust bearing 5, thrust cap 20, and the die table draw bolts 36. Then, re-install thrust cap 20 and align three holes in thrust cap 20 with the three tapped holes in adaptor 1. Install three die table removal bolts 14 until all three are a snug fit. Tighten all three removal bolts 14 alternating from one bolt to another raising adaptor 1 and the four dowel pins 21 in an even manner. Raising adaptor 1 and the dowel pins 21 approximately 2" will clear the four dowels 21 from the openings 29 in die table 7. Raising the four dowel pins 21 and adaptor will raise the upper turret 6A up approximately 1/16", which gives vertical clearance for the die table 7 to be removed from the assembly. Slide die table out horizontally. Note that the die table removal bolts 14 are installed only to remove die table. These bolts 14 are shown in FIG. 1 assembly only to depict where they are installed, but they are not used during operation of the machine. The procedure basically is reversed to re-install the die table, according to the following procedure: Slide the die table 7 horizontally between upper and lower punch turrets. Align number one punch station on die table with the number one punch stations on the upper and lower punch turrets. Remove the three die removal bolts 14, and install draw bolt 2 and tighten it approximately 1" down. Remove draw bolt 2 and install three die table draw bolts 36 and tighten evenly until it forces adaptor 1 and dowel pins 21 back into their original locations, sandwiching adaptor 1, turrets 6A, and 6B, and die table 7 together. Then, install thrust cap 20, bearing 5 and draw bolt 2 and tighten.

Those skilled in the art will understand that the Improved Rotary Tablet Press in its preferred embodiment, is a manually controlled, single-sided, pre-compression press using IPT B, BB, and D-type tooling. A preferred embodiment of the present invention can embody 23 to 35 tablet stations, to provide tablets of a diameter from 0.937 to 0.500, and a tablet thickness of approximately 0.437.

The foregoing description of preferred embodiments is presented for illustrative and descriptive purposes, and it is not exhaustive of the means and methods for practicing and making the invention.

I claim:

1. A rotary tablet press with a rotatable die table and punch turrets with continuously lubricated punch bars fitted in guide bores said apparatus comprising: cabinet means for enclosing said die table and punch turrets; each said punch turret having a first side and a second side proximate to said die table, and a circumferential edge, said edge in contact with means for compartmentalizing said first side from said die table; automatic means for lubricating said punch bars and guides in said first side of each said punch turret; means within said guides of said turret for sealing against lubricant migration from the compartment of said first side of said turret to the compartment of said second side and said die table.

2. Hydraulic die replacement apparatus for a rotary tablet press with a die table with removable dies in openings along a circumferential path on the die table, the apparatus comprising:

upper and lower punch turrets joined in rotatable engagement, and each said turret having at least one punch bar;

a lower die removal means below said circumferential path having a hydraulic cylinder to move a push rod and said punch bar up against a die in said die table, said punch bar having a removable spacer to push said die from said table;

an upper die installation means above said circumferential path having a hydraulic cylinder to move a push rod and said punch bar having a removable spacer to push said die down into said die table.

3. Die table removal apparatus for a rotary tablet press, comprising:

an assembly of a die table between a first punch turret and a second punch turret said assembly having a central shaft opening and one or more dowel openings;

a dowel pin dimensioned to fit removably within each said dowel opening;

central drive shaft means for rotational drive of said assembly, comprising a main drive shaft joined in rotatable engagement to said second punch turret and said main drive shaft joined to a draw bolt, said bolt dimensioned to fit removably within said central shaft opening;

means for withdrawing said dowel pins from said assembly, comprising an adaptor to which said dowel pins are attached, said adaptor being dimensioned to retract within said central shaft opening when said draw bolt is removed.

4. The apparatus of claim 1, further comprising:

an assembly of said die table with removable dies, said die table between a first said punch turret and a second said punch turret, and each said turret having at least one punch bar;

said assembly having a central shaft opening and one or more dowel openings;

a dowel pin dimensioned to fit removably within each said dowel opening;

central drive shaft means for rotational drive of said assembly, comprising a main drive shaft joined in rotatable engagement to said second punch turret and said main drive shaft joined to a draw bolt, said bolt dimensioned to fit removably within said central shaft opening;

means for withdrawing said dowel pins from said assembly, comprising an adaptor to which said dowel pins are attached, said adaptor being dimensioned to retract within said central shah opening when said draw bolt is removed;

hydraulic die replacement apparatus comprising a lower die removal means having a hydraulic cylinder to move a push rod and said punch bar up against a die in said die table, said punch bar having a removable spacer to push said die from said table, and an upper die installation means having a hydraulic cylinder to move a push rod and said punch bar having a removable spacer to push said die down into said die table.

5. The apparatus of claim 1, wherein said means for compartmentalizing comprises a wall internal to said cabinet means, said wall extending from said cabinet inward to said circumferential edge, and a seal along said edge, said seal in contact with said wall.

6. The apparatus of claim 5, wherein said means within said guides for sealing comprises an oil sealing ring in a groove within said guide.

7. The apparatus of claim 6, wherein said means for lubricating comprises keyways drilled into said turrets in fluid contact with said guides.

8. The apparatus of claim 7 wherein said means for compartmentalizing comprises a first wall extending from said cabinet inward to said circumferential edge of an upper turret to provide an upper compartment in said cabinet, and a second wall extending from said cabinet inward to said circumferential edge of a lower turret to provide a lower compartment, and further comprising a pump and an oil reservoir in said lower compartment, and circulation tubing for delivering oil from said reservoir to said punch bars, said guides and said keyways, and further comprising drain tubing through which oil delivered to said upper and lower cabinet returns to said reservoir.

9. The apparatus of claim 2 wherein said lower die removal means further comprises return spring means for said push rod to return said rod after said hydraulic cylinder has moved said rod.

10. The apparatus of claim 3 wherein said central drive shaft means further comprises a threaded joint between said main drive shaft and said draw bolt, and said adaptor is a cylindrical body joined to a bolt collar, said adaptor having an inner diameter approximately conforming to the outer diameter of said draw bolt, and said adaptor having an outer diameter approximately conforming to the diameter of said central shaft opening, and said bolt collar providing means for attachment to said dowel pins, and said collar adapted to fit within a circular recess cut in said first punch turret and joined to said assembly.

11. The apparatus of claim 3 wherein said punch bar comprises a plunger and a tip, joined removably by threads internal to said plunger.

12. The apparatus of claim 4, said punch bar comprising a plunger and a tip joined removably by threads internal to said plunger.

13. The apparatus of claim 4, wherein said means for lubricating comprises keyways drilled into said turrets in fluid contact with said guides and wherein said means within said guides for sealing comprises an oil sealing ring in a groove within said guide, and wherein said means for compartmentalizing comprises a first wall extending from said cabinet inward to said circumferential edge of an upper turret to provide an upper compartment in said cabinet, and a second wall extending from said cabinet inward to said circumferential edge of a lower turret to provide a lower compartment, and further comprising a pump and an oil reservoir in said lower compartment, and circulation tubing for delivering oil from said reservoir to said punch bars, said guides and said keyways, and further comprising drain tubing through which oil delivered to said upper and lower cabinet returns to said reservoir.

* * * * *